US006363829B1

(12) United States Patent
Franchino et al.

(10) Patent No.: US 6,363,829 B1
(45) Date of Patent: Apr. 2, 2002

(54) DRUM SEAL FOR PRIMER FEED MECHANISM

(75) Inventors: Anthony R. Franchino, Whitehouse Station; Thomas Tighe, Morristown, both of NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/570,983

(22) Filed: May 15, 2000

Related U.S. Application Data

(60) Provisional application No. 60/134,772, filed on May 18, 1999.

(51) Int. Cl.[7] ..... F41A 3/74
(52) U.S. Cl. ..... 89/26; 89/27.13
(58) Field of Search ..... 89/26, 27.13

(56) References Cited

U.S. PATENT DOCUMENTS 2,504,162 A * 4/1950 Summerbell et al. ..... 89/27.13
3,099,937 A * 8/1963 Bartels ..... 89/24
3,768,362 A * 10/1973 Grimm et al. ..... 89/26
5,054,365 A * 10/1991 Wissing ..... 89/26
5,115,716 A * 5/1992 Doering et al. ..... 89/27.13
5,535,660 A * 7/1996 Zierler ..... 89/26

FOREIGN PATENT DOCUMENTS

DE 2008255 * 1/1973 ..... 89/27.13
DE 2362131 * 6/1975 ..... 89/27.13

* cited by examiner

*Primary Examiner*—Stephen M. Johnson
(74) *Attorney, Agent, or Firm*—Michael C. Sachs; John F. Moran

(57) ABSTRACT

A system for sealing an indexing primer magazine and breech assembly of a barrel-type firearm to contain exhaust gases with the flow passage transfers the increased pressure into a sealing force between the insert and indexing primer magazine. Additionally, component parts of the seal are located out of the direct path of the formed exhaust gases to increase system longevity and safety. A seal is located within a recess of either the insert or indexing primer magazine, that is separated from the flow passage for the hot combustion gases from the primer or propellant charge.

9 Claims, 4 Drawing Sheets

DRUM SEAL FOR PRIMER FEED MECHANISM

RELATED APPLICATIONS

This application claims benefit of filing date May 18, 1999 of provisional application No. 60/134,772, now abandoned the entire file wrapper contents of which application are herewith incorporated by reference as though fully set forth herein at length.

GOVERNMENT INTEREST

The invention described herein may be manufactured, licensed, and used by or for the U.S. Government.

BACKGROUND OF THE INVENTION

1. Field of the Invention

This invention relates to a device and method for sealing the area between an indexing primer magazine and barrel-type gun system. More particularly, an insert within a gun spindle of a breech assembly seals the indexing primer magazine and breech assembly. Most particularly, the insert has a formed recess therein with a face seal housed within the recess to minimize metal to metal contact and increase the service life of the indexing primer magazine. The present invention may be used with several types of indexing primer magazines, such as drum indexing mechanisms.

2. Brief Description of the Related Art

Large gun systems generally have a breech assembly with a movable breechblock. In a closed position, the breechblock defines a passage between a positioned primer cartridge and loaded propellant charge, permitting open communication between the two. The gun systems are fired by inserting a primer cartridge into the breech assembly after loading a projectile and propellant charge into the gun. The primer cartridge may be inserted into the breech assembly by hand, however, automated gun systems insert the primer cartridge with an indexing primer magazine. The indexing primer magazine retains multiple primer cartridges, and indexes an unfired primer cartridge into a firing position with the expulsion of a previously fired primer cartridge. After an individual primer cartridge is positioned by the indexing primer magazine to fire into the breech assembly of the gun system, the positioned primer cartridge is struck for firing. The fired primer cartridge produces hot combustion gases that flow through the passage in the breech assembly until contacting the loaded propellant charge in the gun. On contact, the gases ignite the propellant charge which in turn fires the projectile from the gun.

The indexing primer magazine is located at the rear surface of the breech assembly, and provides a rapid and readily available source of primer cartridges to the breech assembly. Firing the propellant charge with the primer creates a severe environment in the vicinity of the primer feed mechanism from the hot gases resulting from the combustion of the propellant charge. Difficulties with the indexing primer magazines include maintaining a tight gas connection between the magazine holding the primer cartridges and the flow passage of the breechblock. When individual primer cartridges are fired, increased pressures and temperatures are created within the breech assembly. Gas pressures of up to 60,000 psi, and temperature of up to 3000° K., are encountered within the flow passage. These pressures are retained within the breech assembly to ensure proper indexing of the indexing primer magazine. The pressures are retained with the breech assembly to ensure a safe environment for the soldier and to prevent damage to primer feed mechanism components. As such, the interface between the breech assembly and indexing primer magazine needs to be effectively sealed, i.e., retain the repetitious high pressures and temperatures of the hot combustion gases of the primer cartridge and fired propellant in an operational environment, such as a battlefield. The seal needs to be reliable over multiple firings as escape of the high pressures from the flow passage presents a danger to local personnel and equipment. Failure to provide a reliable seal between the magazine and breech faces may ignite adjacent unspent primers, thereby causing weapon misfires and damage to the primer feed mechanism, making the weapon unusable until it can be serviced. This failure also significantly decreases the service life of the gun system. More importantly, an unreliable seal can create a dangerous environment for the gun crews required to fire the weapon, resulting in possible injury or death.

Seals to retain the high pressures formed within the flow passage have been previously disclosed. For example, U.S. Pat. No. 5,535,660 to Zierler, entitled "Breech Closure for a Barrel-type Firearm", issued on Jul. 16, 1996, discloses one method for retaining the high pressures. The Zierler patent discloses a sealing system that accommodates high and low pressures within the flow passage. However, several problems are encountered with the breech closure disclosed in Zierler, which include seal leakage, over time, from metal-to-metal contact, and steel erosion from heat checking of the magazine. For the metal cup seal disclosed in Zierler to operate properly, the primer hole on the drum component must be smaller in diameter than that of the hole in the cup, since the cup is self-energizing and slightly conical in shape, i.e., similar to a Belleville spring. This feature exposes the periphery of the drum hole to damage from being in the direct path of the hot primer gases. As the metal seal is extremely sensitive to sealing surface imperfections, the heat checking creates a source of premature seal failure. Heat resistant coatings improve, but do not eliminate, the heat stress. Live fire testing on howitzers having a mechanism such as that disclosed in the Zierler patent results in severe heat checking on the drum surface and the underside of the metal cup seal surface, which has resulted in leak paths for the created hot propellant gases. These problems decrease the longevity of the magazine and safety of the equipment.

In view of the foregoing, there is a need for improvements in the sealing the indexing primer magazine with the breech assembly in a gun system. The present invention addresses this and other needs.

SUMMARY OF THE INVENTION

An object of the present invention is to provide a reliable and effective seal between the breech assembly and indexing primer magazine while minimizing metal to metal contact of the gun system.

The present invention includes an insert for sealing an indexing primer magazine and breech assembly of a gun system comprising an elongated body having a central bore extending therethrough from a first open end to a second open end thereof, the insert being positioned with the first open end in a gun spindle of the gun system and the second open end extending outside of the gun spindle, the second open end of the elongated body having a flat surface perpendicular to the central bore, wherein the central bore is approximately centered within the flat surface, a recessed area formed within the flat surface and circumferentially surrounding and outside of the central bore, the recessed area comprising at least an inner extension and outer extension of the elongated body such that the inner extension defines the distance between the central bore and recessed area, and a face seal fixed within the recessed area, wherein the face seal forms direct contact to the indexing primer magazine.

The present invention also includes a method for sealing an indexing primer magazine and breech assembly comprising the steps of providing an insert fixed within the breech assembly, the insert having an elongated body having a central bore extending therethrough from a first open end to a second open end thereof, the insert being positioned with the first open end in a gun spindle of the gun system and the second open end extending outside of the gun spindle, the second open end of the elongated body having a flat surface perpendicular to the central bore, wherein the central bore is approximately centered within the flat surface, a recessed area formed within the flat surface and circumferentially surrounding and outside of the central bore, the recessed area comprising at least an inner extension and outer extension of the elongated body such that the inner extension defines the distance between the central bore and recessed area and a face seal fixed within the recessed area, wherein the face seal forms direct contact to the indexing primer magazine, adjusting the insert to press the face seal against the indexing primer magazine and initiating the primer within the indexing primer magazine to fire the gun.

Additionally, the present invention includes an indexing primer magazine that forms a seal with a breech assembly comprising a supporting body forming at least one opening effective to house a primer cartridge, the formed opening extending through the supporting body at the discharge head of the primer cartridge effective to longitudinally align the primer cartridge within the supporting body along the axis of a formed bore within the breech assembly, at least one recessed area formed within the supporting body and circumferentially surrounding and outside of the formed opening through the supporting body, the recessed area comprising an inner extension and outer extension of the supporting body such that the inner extension defines the distance between the formed opening through the supporting body and the recessed area and a face seal fixed within the recessed area, wherein the face seal forms direct contact to the breech assembly.

Furthermore, the present invention includes a sealed indexing primer magazine and breech assembly product formed by the process comprising the steps of aligning a primer opening formed within a indexing primer magazine with the central bore formed within a gun insert to form a conduit therethrough and locating a face seal between the indexing primer magazine and insert, wherein the face seal is separated from the formed conduit such that increased pressure within the conduit flows into the face seal and forces the face seal to seal the area between the indexing primer magazine and breech assembly.

Other and further advantages of the present invention are set forth in the description and appended claims.

DETAILED DESCRIPTION OF THE PREFERRED EMBODIMENTS

The present invention addresses the problems associated with reliable and effective seals between an indexing primer magazine and breech assembly within a gun system. The present invention provides a sealing between the indexing primer magazine and breech assembly, that is preferably embodied in an insert. The present invention includes an insert for sealing the area between the indexing primer magazine and breech assembly, the sealing mechanism fixed to the indexing primer magazine, methods of sealing the indexing primer magazine and breech assembly with the insert, and the seal product that incorporates a face seal. The insert of the present invention includes a recessed area having a face seal that is separate from the gas conduit for the explosive gases, both primer cartridge and propellant charge, within the gun system. The insert is placed within the gun system by attachment to a gun spindle, with the end of the insert having the face seal extending towards the back end of the gun barrel. By separating the seal from the gas conduit, the seal remains clear of the deleterious affects of the increased pressures and temperatures from the combustion gases of the primer cartridge and propellant charge, while utilizing the increased pressure within the gun system to augment sealing effectiveness and minimizing metal-to-metal contact between the breech assembly with the indexing primer magazine. As such, the insert significantly increases the service life of the indexing primer magazine. The present invention may be used with numerous large artillery gun systems that incorporate indexing primer magazines for firing, including for example, without limitation, the 155 mm artillery cannon. The present invention is particularly useful in a gun system having a drum indexing mechanism.

Figure 1:
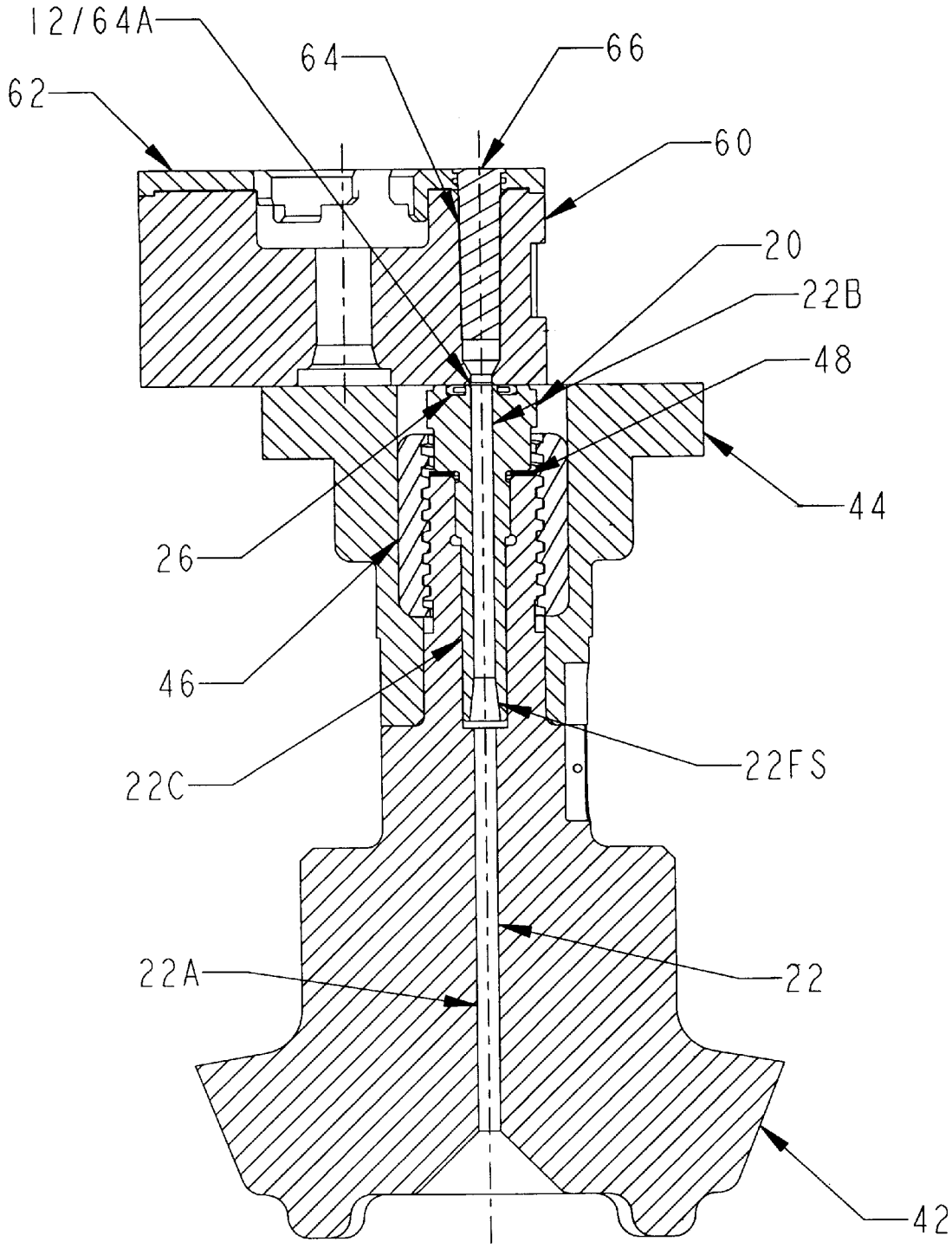
FIG. 1 illustrates the insert positioned within the breech assembly of a gun system, with a magnified view of the insert-magazine interface shown in FIG. 1A.

In FIG. 1, a gun system 10 incorporating the gun sealing apparatus is shown. The gun system 10 includes an insert 20 positioned within a breech assembly 40, with the insert 20 further adjacent to an indexing primer magazine 60. As further seen in FIG. 1, FIG. 1A and the exploded view in FIG. 2, the breech assembly 40 includes a spindle 42 that is fixed within the bore of the gun system 10, which is used as a positioning device for the insert 20. The spindle 42 is locked within a primer feed mechanism body 44 using a nut component 46. Adjacent to and interlocked with the nut assembly 46, the insert 20 remains in a fixed position that is adjustable by manipulation of a shim 48. Within the center of the insert 20 and spindle 42, a central bore 22 is formed. The insert 20 creates an effective seal 12 between the breech assembly 40 and magazine 60, such that the service life of the gun system 10 is extended.

The magazine 60 is positioned adjacent to the breech assembly 40, and includes a primer ring 62 for attaching the magazine 60 onto the breech assembly 40. Openings 64 are formed in the magazine 60 for holding primer cartridges 66 within the magazine 60. The magazine has at least one opening 64, with multiple openings 64 preferred, such as 2, 3, 4, 5, 6, etc., openings 64 or more, with the magazine 60 more preferably comprising a drum configuration with ten openings 64. Most preferably the magazine 60 comprises an indexing primer magazine drum. The drum indexing primer magazine may include an attachable drum primer loader cartridge. The magazine 60 effectively houses, i.e., allows functioning within the gun system 10, primer cartridges 66 such that once an individual cartridge 66 is fired another cartridge 66 assumes a firing position with the breech assembly 40. The openings 64 extend through the magazine 60, exposing a pressure firing mechanism across a back plate of the cartridge 66, with a discharge head 68 of the cartridge 66 pointing into the central bore 22 of the insert 20. The position of the opening 64, with the cartridge 66 inserted and in a firing position, effectively aligns the discharge head 68 of the cartridge 66 (as an endpoint of the longitudinal center of the cartridge 66) along a longitudinal center axis of the formed central bore 22 within the insert 20. At the discharge head 68 of the cartridge 66, the opening 64A extends through the magazine 60 to allow the combustion gases of the cartridge 66 to exit the opening 64 and enter the second open end of the central bore 22B of the insert 20 and into the breech assembly 40. The magazine 60 and insert 20 are separated by a maximum distance of from about 0.002 inch or less.

The opening 64A through the magazine 60 adjacent to the discharge head 68 of the cartridge 66 comprises a larger diameter ($d_1$) opening 64A than the diameter ($d_2$) of the second open end 22B of the central bore 22 within the insert 20. As propellant back gases from the exploding propellant charge pass through the central bore 22 into the opening 64A, the propellant back gases do not encounter sharp edges or ridges internally within the magazine 60. The diameter difference allows only exposed smooth surfaces of the magazine 60 to be exposed to the excessive pressure and heat of the propellant back gases. Degradation of the magazine 60 surfaces becomes minimized, allowing longer service life. Preferably, the formed opening 64A through the magazine 60 comprises a chamfer configuration facing the insert 20, i.e., face seal 26. In addition to facilitating the flow of propellant back gases across smooth surfaces in the magazine 60, the chamfer furnishes pressurization from the central bore 22 into the adjacent face seal 26.

Figure 1A:
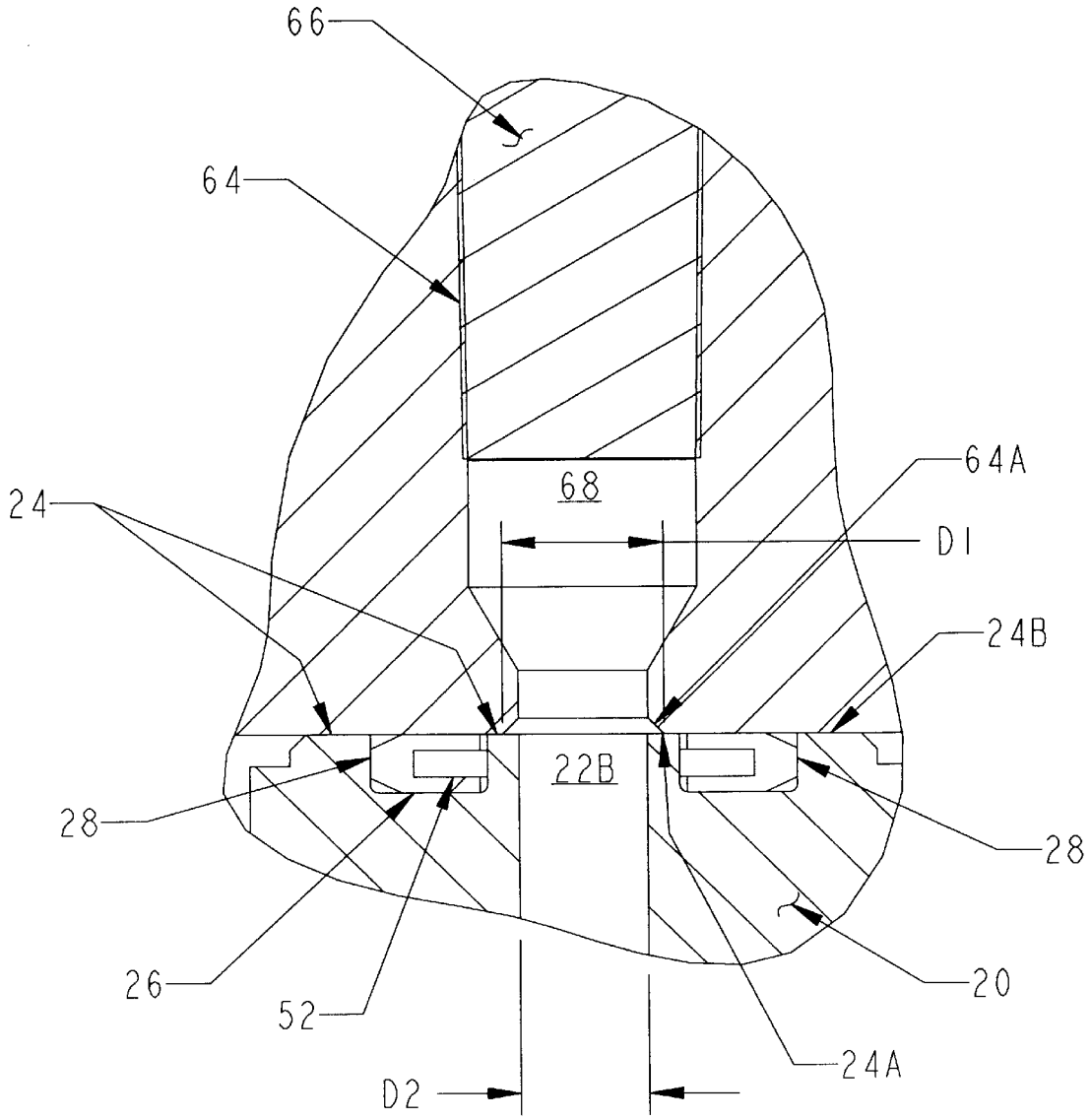
Figure 2:
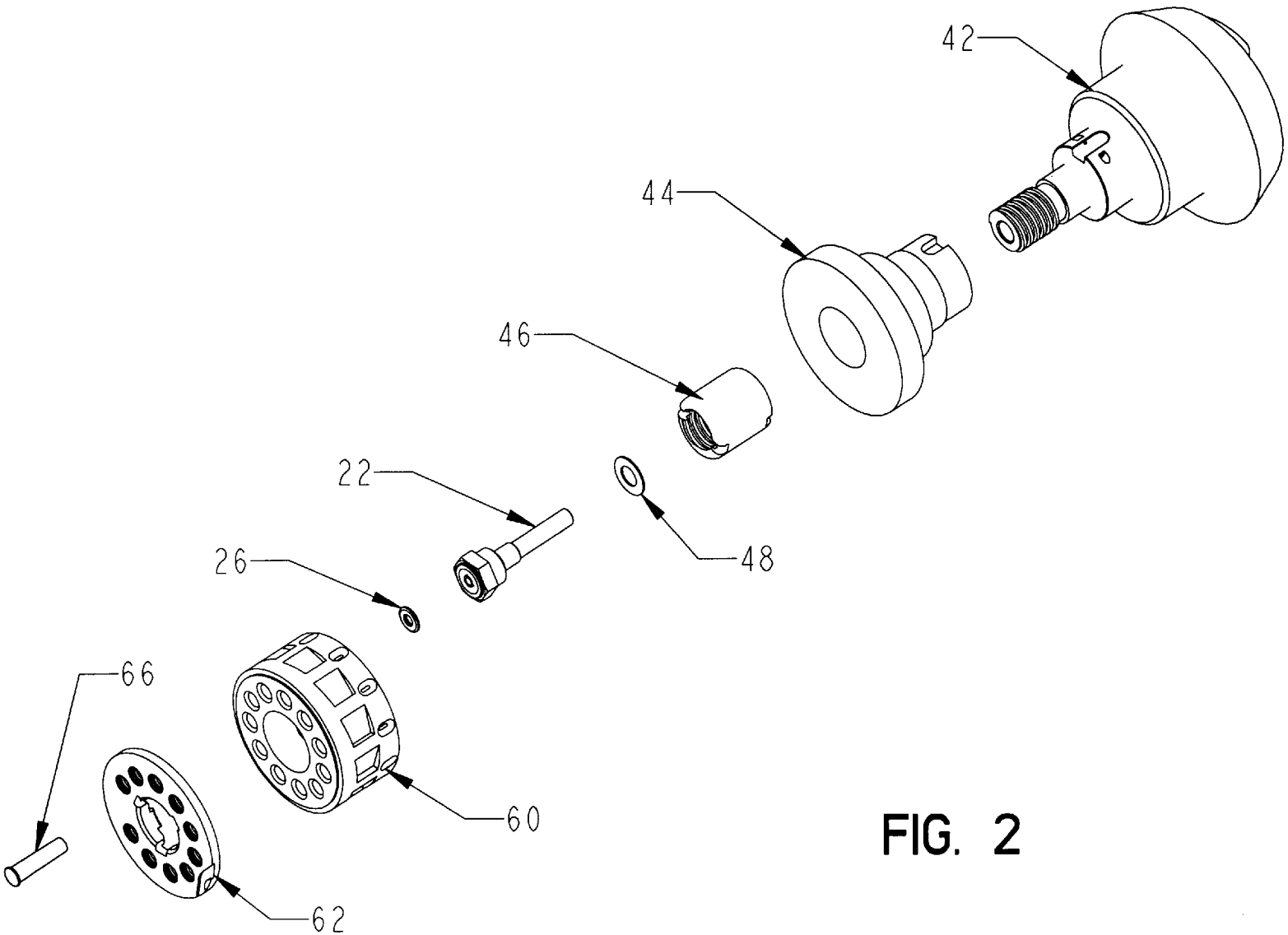
FIG. 2 illustrates an exploded view of the insert and face seal of the present invention in relation to indexing primer magazine and breech assembly components; and, FIG. 3 illustrates an alternative embodiment having the face seal attached to the indexing primer magazine.

As further seen in FIGS. 1, 1A and 2, the insert 20 positions the face seal 26 against the magazine 60, and uses the face seal 26 to seal the interface between the magazine 60 and breech assembly 40. The insert 20 comprises an elongated body having a central bore 22 extending therethrough between a first open end 22A and a second open end 22B of the elongated body. The insert 20 is positioned with the first open end 22A in the gun spindle 42 and the second open end 22B extends outside of the gun spindle 42.

The second open end 22B of the insert 20 comprises a flat surface 24 with a circular shape that is perpendicular to the central bore 22. The central bore 22 is approximately centered within the flat surface 24 and remains centered throughout the length of the insert 20. A recessed area 28 is formed within the flat surface 24 on the second open end 22B that circumferentially surrounds the opening of the central bore 22 found through the second open end 22B. The recessed area 28 is separate from the central bore 22, i.e., an area of the flat surface 24A of the second open end 22B extends between the depth of the recessed area 28 and the central bore 22, outside of the circumference of the central bore 22. As such, the recessed area 28 has at least an inner extension 24A and outer extension 24B of the insert 20 such that the inner extension 24A defines the distance between the central bore 22 and recessed area 28, i.e., the outer diameter of the central bore 22 and the inner diameter of the recessed area 28. The inner extension 24A of the recessed area 28 comprises any suitable width for proper pressurization of the face seal 26, with the proper width determinable by those skilled in the art in light of the teaching herein, preferably with a width of from about 0.025 inch to about 0.25 inch. The outer extension 24B of the recessed area 28 also comprises any suitable width for face seal 26 functioning, with the proper width determinable by those skilled in the art in light of the teaching herein, preferably with a width of from about 0.25 inch to about 0.5 inch.

Within the insert 20, at least part of the central bore 22 comprises a constant diameter central bore 22C. The insert 20 further includes a funnel section 22FS within the central bore 22 that restricts the diameter of the central bore 22 from the first open end in the direction of the second open end. The funnel section 22FS restricts the back gasses from the exploding propellant charge traveling back towards the magazine 60.

The face seal 26 is fixed within the recessed area 28 in a manner that allows the face seal 26 direct contact with the magazine 60, when the magazine 60 is positioned adjacent to the breech assembly 40. The face seal 26 preferably comprises an internal spring mechanism 52, such as a canted coil. The composition of the surface of the face seal 26 comprises any suitable heat resistant composition for use within the gun system, with the proper surface coating determinable by those skilled in the art. The preferred surface coating of the face seal 26 comprises a Teflon® surface.

The insert 20 includes a means for attaching the first open end in the gun spindle 46, which preferably comprises the nut assembly 46 or similar device. This means for attaching the first open end 64 may comprise any securing device that stabilizes the insert 20 into the spindle 42, such as the nut assembly 46. The nut assembly 46 is utilized to physically attach the primer feed mechanism body 44 to the spindle 42. The nut assembly 46 can be installed and removed independently of the insert 20, thereby simplifying assembly.

As shown in FIGS. 1 and 2, the insert 20 is pat of a sealing apparatus for the magazine 60 and breech assembly 40. With the magazine 60 located adjacent to the second open end of the insert 20, a gap area between the face of the insert 20 and magazine 60 exists. The shim 48 is used to effectively adjacent to the insert 20, towards and away from the magazine 60, to a functioning firing position that allows the insert 20 to seal the breech assembly 40 and magazine 60 together, i.e., a sealed gun.

The insert 20 is threaded into a spindle 42, a face seal 26, and a nut assembly 46. The insert 20 provides the gland for the face seal 26 and is axially adjusted through the use of shims 48. The low-friction Teflon face seal utilizes a spring to energize in low-pressure environments, and is configured to self-energize under higher pressure environments. The Teflon seals are rated for temperatures in excess of 500° F., which exceeds cookoff temperature requirements for the howitzer. The seals are physically attached to the insert by a light interference fit on the seal's outer diameter, thereby reducing the parts count and aiding in seal installation and removal.

The primer feed mechanism utilizes a rotating drum, which stores as many as ten cartridges 66. Utilizing the energy to close the armament's breech mechanism after loading a round and propelling charge, the primer feed mechanism rotates a fraction of a revolution, thereby aligning a fresh primer with the projectile, the propelling charge and the firing pin. The magazine 60 forms a seal with the breech assembly 40. The magazine 60 effectively houses the primer cartridge within an opening in the magazine 60 for firing the primer cartridge into the breech assembly 40 for propellant ignition. The opening of the magazine 60 extends through the magazine 60 at the discharge head 68 of the cartridge 66 effective to longitudinally align the head of the cartridge 66 located within the magazine 60 along the axis of a formed bore 22 within the insert 20.

The insert 20 preferably includes a shim 48 adjacent to the first open end of the insert 20. The shim 48 may be rotationally manipulated to effective to adjust the position of the insert 60 longitudinally along the length of the bore of the breech assembly 40 to place the second open end of the insert 20 at a closer or farther distance from the face of the magazine 60. The shim 48 preferably adjusts the insert 20 distances from about 0.001 inch to about 0.050 inch, with increments of from about 0.001 inch or less preferably used with the shim 34. The indexing primer magazine and insert are separated by a maximum distance of from about 0.002 inch or less.

Figure 3:
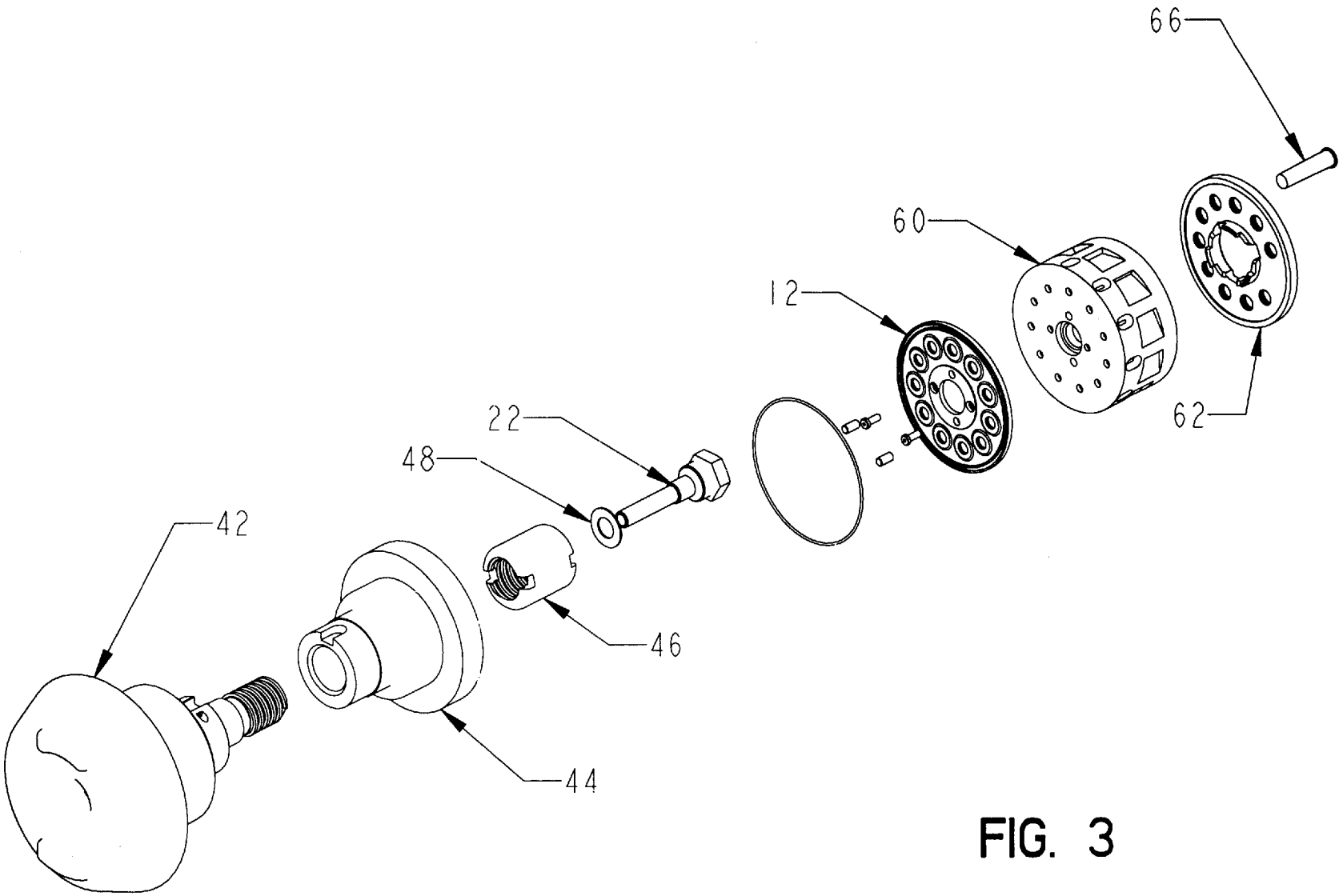

FIG. 3 illustrates an alternative embodiment having the face seal 26 attached to the indexing primer magazine 60. In the alternative embodiment, the magazine 60 comprises a plurality of formed opening and an equal number of formed recessed areas, with each formed opening corresponding to a single formed recessed area. Preferably, the magazine 60 comprises a drum configuration, with the drum indexing primer magazine more preferably configured to receive an attachable drum primer loader cartridge. In the alternative embodiment, the seal 12 is placed around each of a plurality of primer holes on the drum 60, instead of having the face seal 26 located on the insert 20. In this alternative embodiment, the seal 12 on the magazine 60 is used in concert with the insert 20, i.e., the insert 20 is used to connect with the seal 12, subjecting at least one of the seals 12 to the firing pressures for each round fired. This permits the same sealing action, and accordingly the same benefits, for the gun system 10. In either embodiment, the sealing system increases the functional service life of the magazine 60, with anticipated increases of service life increasing by a factor of approximately at least two, and possibly five or ten.

In operation, the magazine 60 and breech assembly 40 are sealed with the previously described insert 20 by adjusting the insert 20 to press the face seal 26 thereon against the adjacent face of the magazine 60 with the shim 48. The cartridge 66 is then initiated within the magazine 60. Once initiated, the hot combustion gases from the cartridge 66 detonate the propellant charge within the gun system 10. As pressure increases within the central bore 22, pressure "bleeds" pass the inner extension 24A of the flat surface of the insert 20, and pressurizes the face seal 26. The added pressure ensures a proper seal of the gun system 10.

The effective sealed gun system 10 results from the face seal 26 being separate from the conduit, i.e., central bore 22, carrying the transiting pressures and temperature of the cartridge 66 gasses and propellant charge gasses, while receiving increased pressure from the conduit to force the face seal 26 to seal the area between the magazine 60 and breech assembly 40.

The gun system 10 incorporating the insert 20 of the present invention has an increased service life that results from minimizing metal-to-metal contact in the seal. Seal effectiveness occurs from tapping into the resulting pressure of the fired cartridge 66 and propellant charge through the formed conduit into the face seal 26 between the magazine 60 and breech assembly 40. The increased pressure within the conduit flows between the interface of the magazine 60 an breech assembly 40 and into the face seal 26. The spring loaded and pressurized face seal 26 is forced against the magazine 60, and creates an effective seal.

The sealing mechanism uses a true self-energizing face seal, the necessity to have features, such as the drum primer hole, directly in the path of the hot propellant gases is eliminated. As the seal is elastomeric in nature, it is far less sensitive to slight sealing surface flaws than a metal-to-metal sealing arrangement, and it can be impregnated with materials such as graphite to lower mechanism drag without compromising sealing effectiveness. Additionally, maintenance of the gun system 10 having the insert 20 utilizes common hand tools and does not need complete disassembly of the primer feed mechanism for gland axial adjustment, resulting in simplified maintenance procedures. The physical size of the sealing mechanism is small, and the pressures resulting from the exploding propelling charge do not compromise either the structural or sealing integrity of the primer feed mechanism. This eliminates exposure to severe heat checking on critical sealing components within the gun system 10 as the sealing faces remain outside of the direct path of the gases. The seal 12, being away from the direct increased pressures and temperature, is less sensitive to sealing surface conditions. Manufacture, adjustment and assembly of the sealing mechanism are easier, particularly in field conditions. Forces transmitted to the drum are minimized resulting in maintaining the seal and the structural integrity of the mechanism. The seal tightness retains the gases, i.e., pressures, encountered by the gun system 10 during the firing of the cartridge 66 and propellant, while permitting further indexing of the magazine 60 in relation to the breech assembly 40.

EXAMPLE 1

A breech assembly of a gun, having a breech block mounted on a carrier, is opened by pivotally moving the breech block and carrier about an axis perpendicular to the axis of the barrel of the gun. Once open, the gun is loaded with a projectile and propellant charge. After loading, the gun is placed back to a closed position where the breech assembly seals the rear of the gun barrel so that the gun can be fired.

Within the gun, a passage is formed between a primer cartridge and the propellant charge though an insert in the breech assembly, with the position of the loaded propellant charge allowing ignition of the propellant with an primer cartridge. The primer cartridge is held in a drum magazine which is rotated about the drum axis by one primer cartridge whenever the breech block is closed. This permits the alignment of a non-fired ignition cartridge at the breech of the gun each time the breech block is closed, leaving the gun ready to be fired. The automatic changing of the primer cartridges within the primer magazine occurs with maintaining a given pressure within the breech during firing.

With ignition of the primer cartridge, hot combustion gases from the primer cartridge flow through the passage in the insert to the propellant charge and ignites the propellant. Pressure is maintained within the breech with a seal between the insert and primer magazine. The seal is fitted in a recess formed circumferentially within the insert. As propellant charge gases flow through the passage in the direction of the primer magazine, the space between the insert and magazine becomes pressurized. Increased pressures enter the seal, cause increase sealing pressure against the magazine surface. With the increased seal pressure, the seal is able to retain the seal against gases escaping between the breech assembly and primer magazine.

It should be understood that the foregoing summary, detailed description, example and drawings of the invention are not intended to be limiting, but are only exemplary of the inventive features which are defined in the claims.

What is claimed is:

1. A gun system having an indexing primer magazine and breech assembly and an insert for sealing said indexing primer magazine and said breech assembly, said insert having an elongated body, and said insert being positioned with a first elongated body open end in a gun spindle of the gun system and a second elongated body open end extending outside of the gun spindle; said insert further having a nut assembly means for attaching said first elongated body open end in said gun spindle; said insert further having a central bore extending therethrough from a first central bore open end to a second central bore open end thereof; and said second elongated body open end having a flat surface perpendicular to said central bore, wherein the central bore is approximately centered within said flat surface; and a recessed area formed within said flat surface and circumferentially surrounding and outside of the central bore, said recessed area comprising at least an inner extension and outer extension such that said inner extension defines the distance between said central bore and a face seal fixed within said recessed area, wherein said face seal forms direct contact to said indexing primer magazine; and wherein said central bore comprises a funnel section that restricts the diameter of said central bore from the first central bore open end in the direction of the second central bore open end.

2. A gun system as in claim 1, further comprising a sealing indexing primer magazine and breech assembly apparatus; wherein the indexing primer magazine is located adjacent to said second elongated body open end the indexing primer magazine forming at least one opening effective to house a primer cartridge, such formed opening extending through the indexing primer magazine at a discharge head of the primer cartridge effective to longitudinally align said primer cartridge along the axis of said central bore; said gun system further comprising a shim adjacent to the insert effective to adjust the position of the insert in relation to the indexing primer magazine.

3. A gun system as in claim 2, wherein said formed opening through the indexing primer magazine adjacent to the insert comprises a larger diameter than the diameter of said second elongated body open end.

4. A gun system as in claim 1, wherein said indexing primer magazine comprises a drum configuration.

5. A gun system as in claim 1, wherein the inner extension of said recess area comprises a width of from about 0.025 inch to about 0.25 inch.

6. A gun system as in claim 1, wherein the outer extension or said recess area comprises a width of from about 0.25 inch to about 0.5 inch.

7. A gun system as in claim 1, wherein said face seal comprises a spring having a canted coil.

8. A gun system as in claim 1, wherein said indexing primer magazine and said insert are separated by a maximum distance of from about 0.002 inch or less.

9. A gun system as in claim 1, wherein said gun system comprises a 155 mm artillery cannon.

* * * * *